United States Patent [19]

Johnston et al.

[11] 4,027,801

[45] June 7, 1977

[54] OUTRIGGER SYSTEM FOR VEHICLES

[75] Inventors: Roger L. Johnston, Muskego; Daniel C. Wiencek, Milwaukee, both of Wis.

[73] Assignee: Bucyrus-Erie Company, South Milwaukee, Wis.

[22] Filed: May 21, 1976

[21] Appl. No.: 688,925

[52] U.S. Cl. ..... 212/145; 280/763

[51] Int. Cl.[2] ..... B66C 23/62

[58] Field of Search ..... 280/763–766; 254/86 R; 248/145, 352; 212/145, 144

[56] References Cited

UNITED STATES PATENTS

| | | | |
|---|---|---|---|
| 3,021,016 | 2/1962 | Noll et al. | 212/145 |
| 3,061,113 | 10/1962 | Johnson | 212/145 |
| 3,780,877 | 12/1973 | Levitt | 212/145 |
| 3,981,514 | 9/1976 | Visser | 212/145 |

*Primary Examiner*—Lawrence J. Oresky
*Attorney, Agent, or Firm*—Quarles & Brady

[57] ABSTRACT

An outrigger system for use with mobile cranes, power shovels, and other vehicles requiring rigid ground support, comprises a telescoping beam outrigger system of the type having a pair of outrigger arms each of which comprises a beam telescopically stored in a horizontally disposed housing. The improvement comprises providing an arm construction in which the housing, as well as, the beam is extendible sidewardly. In a preferred embodiment the housing also tilts or translates downwardly as it is extended.

8 Claims, 9 Drawing Figures

13
15
17
18
28
26
27
22
21
23
31
9
20
9
36
33
29
37
38
32
39
40
7
7
24
34
25
10
35
10
16
17a
19

OUTRIGGER SYSTEM FOR VEHICLES

BACKGROUND OF THE INVENTION

The invention pertains to an improved outrigger system for power shovels, mobile cranes, and other vehicles requiring rigid ground support for safe and effective use.

In the past, vehicles requiring rigid ground support generally have been equipped with some form of telescoping beam outrigger system to give them increased stability. The most common type of outrigger system is the two-beam system in which each outrigger arm comprises an extendible beam provided at its outer end with a foot for ground contact; the beam is positioned within a second stationary beam which serves as the housing and is fixed to the vehicle. In instances where greater stability has been required an outrigger system utilizing three beams has been employed. In the three-beam system, one beam is stationary and serves as the housing and each of the other two of the beams is telescoped therein and may be extended out to produce a greater outrigger spread than is obtainable with the two-beam system. However, the three-beam system does weigh more and is more expensive than the two-beam system.

There have been numerous outrigger systems designed and patented.

For example, the Person U.S. Pat. No. 3,279,622 and the Wieschel U.S. Pat. No. 3,073,458 disclose two-beam systems in which the beam serving as the housing is disposed in the horizontal position for vehicle travel and then may be tilted downwardly when the beam is extended and the Noll et al. U.S. Pat. No. 3,021,016 discloses a system in which the extensible beam telescopes within an inclined housing and is extended downwardly and along an angular path. It is an advantage to incline the beams downwardly as it permits the use of relatively small hydraulic cylinders on the float jacks used as ground supports.

Although the prior art systems are useful and commercially acceptable, none provides a system which gives a greater reach than the two-beam system and the weight and the cost savings of the two-beam system. Therefore, there is a continuing need for improvements in outrigger systems.

SUMMARY OF THE INVENTION

It is the primary object of the present invention to provide an improved two-beam outrigger system which provides greater sidewise extension or reach and resulting support for a given beam and housing length than is obtainable with the presently known two-beam outrigger systems and which, in essence, accomplishes the greater reach advantage with significant cost and weight savings.

The novel outrigger system of the present invention is of the type which comprises a support member which is adapted to be attached to a vehicle or a piece of equipment, a pair of opposed outrigger arms carried by said support member, each arm comprising a housing and an extendible beam telescopically positioned within said housing, and means for extending the beam, in which the improvement comprises providing a construction in which not only the beam extends sidewardly but also the housing may be extended sidewardly, thereby providing a greater sideward extension for a given length of housing and beam than has previously been possible with conventional two beam or beam and stationary housing outrigger systems. The provision of the extendible housing provides a very significant advantage for the length of the beam and the housing is for all practical purposes limited by the width of the vehicle to which it is attached. Therefore, the outrigger system of the present invention which provides a greater sideward extension or reach for a vehicle equipped with such an outrigger system makes it possible for that vehicle to have not only a greater capacity but also a greater stability or margin of safety than a similar vehicle equipped with a conventional two beam outrigger system.

The preferred embodiment of the outrigger system of the present invention provides another substantial advantage. For not only does the housing extend sidewardly, but the novel housing also tilts or translates downwardly so that the float pad equipped free ends of the beams both approach the ground more quickly and directly. This makes it possible for the float pads to be equipped with shorter vertical fluid-actuated cylinders than in conventional outrigger systems. The shorter vertical cylinder not only weighs and costs less than larger cylinders, but it also can be retracted into the housing to maximize beam length and minimize overhang.

Another advantage of the novel outrigger system of the preferred embodiment of the present invention is that it uses a single hydraulic cylinder to both translate or tilt the housing and to extend the beam. The result is a substantial weight and cost savings over previously known outrigger systems which employ two separate cylinders, one for each purpose.

Various other pictures, objects and advantages will be apparent from the description to follow.

DESCRIPTION OF THE PREFERRED EMBODIMENT

Figure 1:
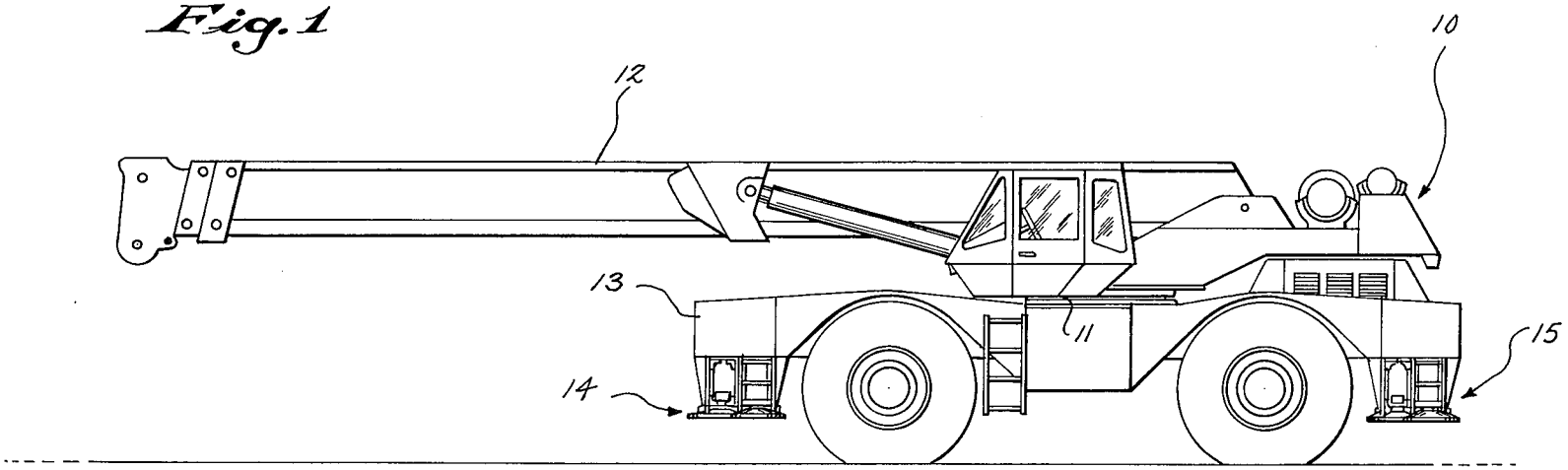
FIG. 1 is a side view in elevation of a truck crane including front and back outrigger assemblies constituting preferred embodiments of the present invention.
Figure 2:
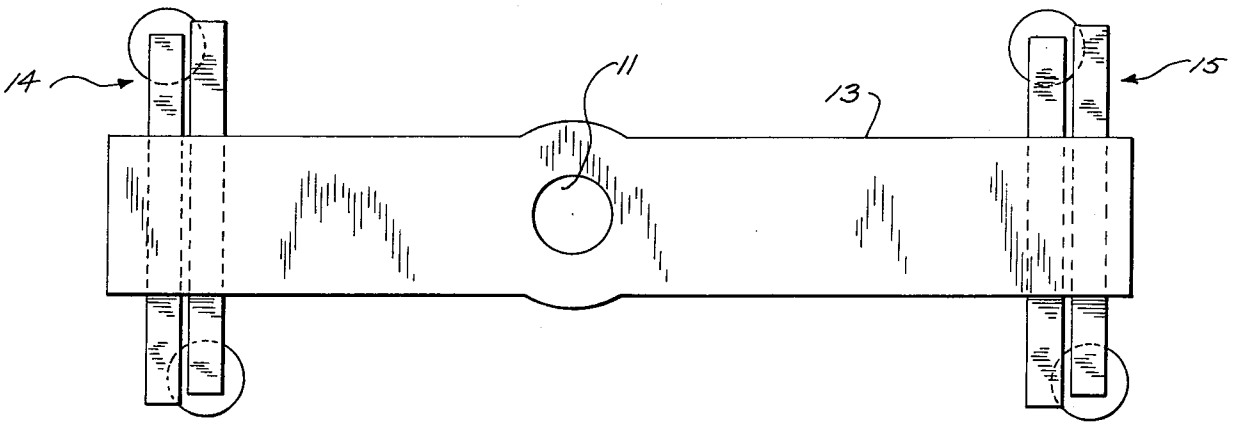
FIG. 2 is a top view of the truck crane of FIG. 1.

In the drawings, FIGS. 1 and 2 illustrate schematically a vehicle 10 having mounted thereon on a turntable 11, and a crane boom 12 for swivelling movement on the vehicle frame 13, the frame 13 being supported when in transit by front and rear wheels.

In addition to the turntable 11 and the boom 12, the frame carries two outrigger systems 14 and 15 including a first outrigger system 14 positioned ahead of the front wheels of the vehicle and a second system 15 located just behind the rearmost wheels of the vehicle. The two outrigger systems 14 and 15 are provided to insure that the vehicle 10 will remain laterally stable when the crane 12 is operating. While for purposes of illustration the outrigger systems are illustrated on a crane it will be understood that they also can be used with advantage on power shovels, equipment for loading heavy items and any other type of equipment which requires supplement lateral support.

Figure 3:
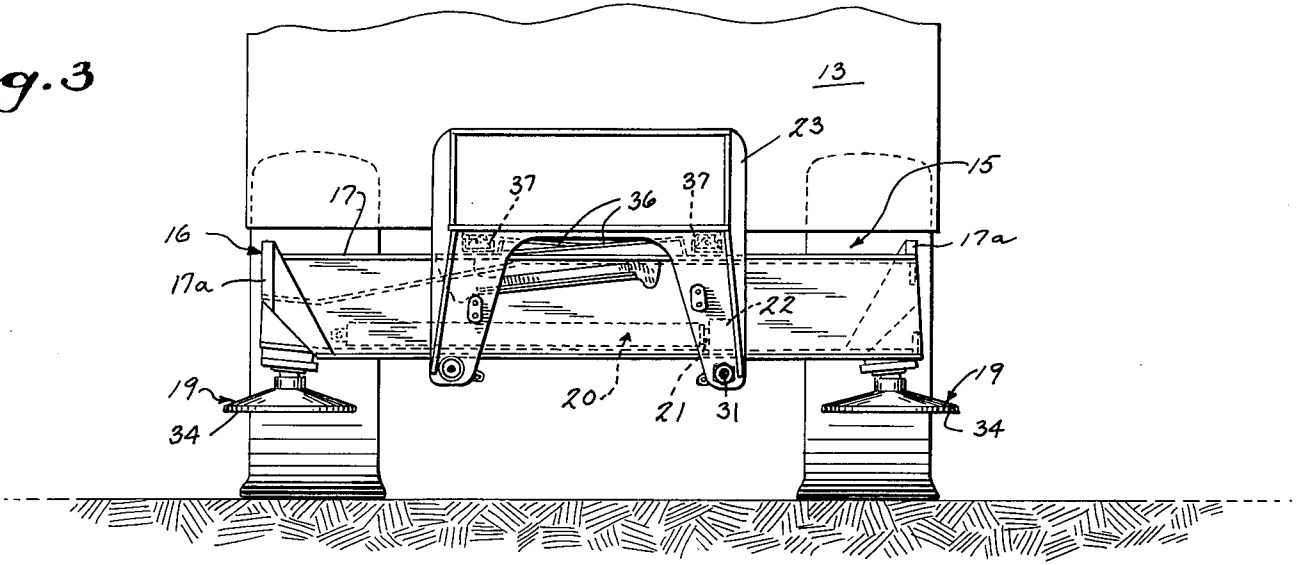
FIG. 3 is an enlarged rear view of the truck crane of FIG. 1.
Figure 4:
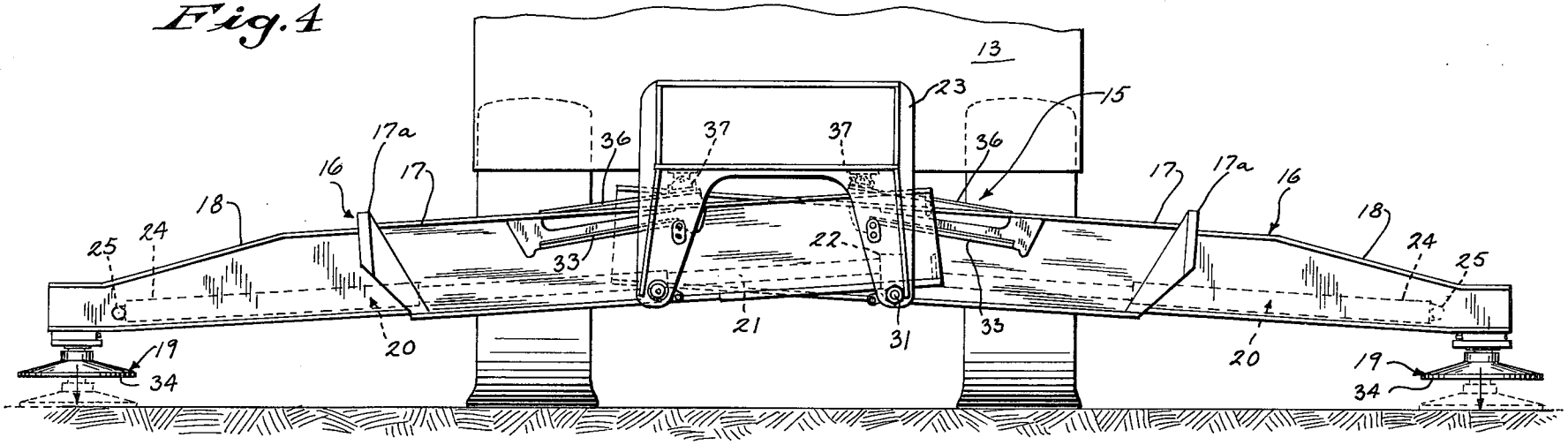
FIG. 4 is an enlarged rear view of the truck crane of FIG. 1 with the outrigger assembly fully extended.

FIGS. 3 and 4 illustrate the rear outrigger unit 15 in storage position and in use, respectively. As seen in FIG. 4, the rear outrigger system 15 is comprised of two arms 16 each of which has a housing 17, and a beam 18 which is provided at its free end with float jacks 19.

The beam 17 and the housing 18 are preferably in the form of hollow rectangular bodies and, as seen best in FIG. 4, both the beam 18 and the housing 17 can be extended sidewardly from the position seen in FIG. 3, which is the normal storage position. In addition, in FIG. 4, it can be seen that the beam 18 and the housing 17 are extended not only sidewardly, but also they are tilted or translated angularly downwardly.

Figure 5:
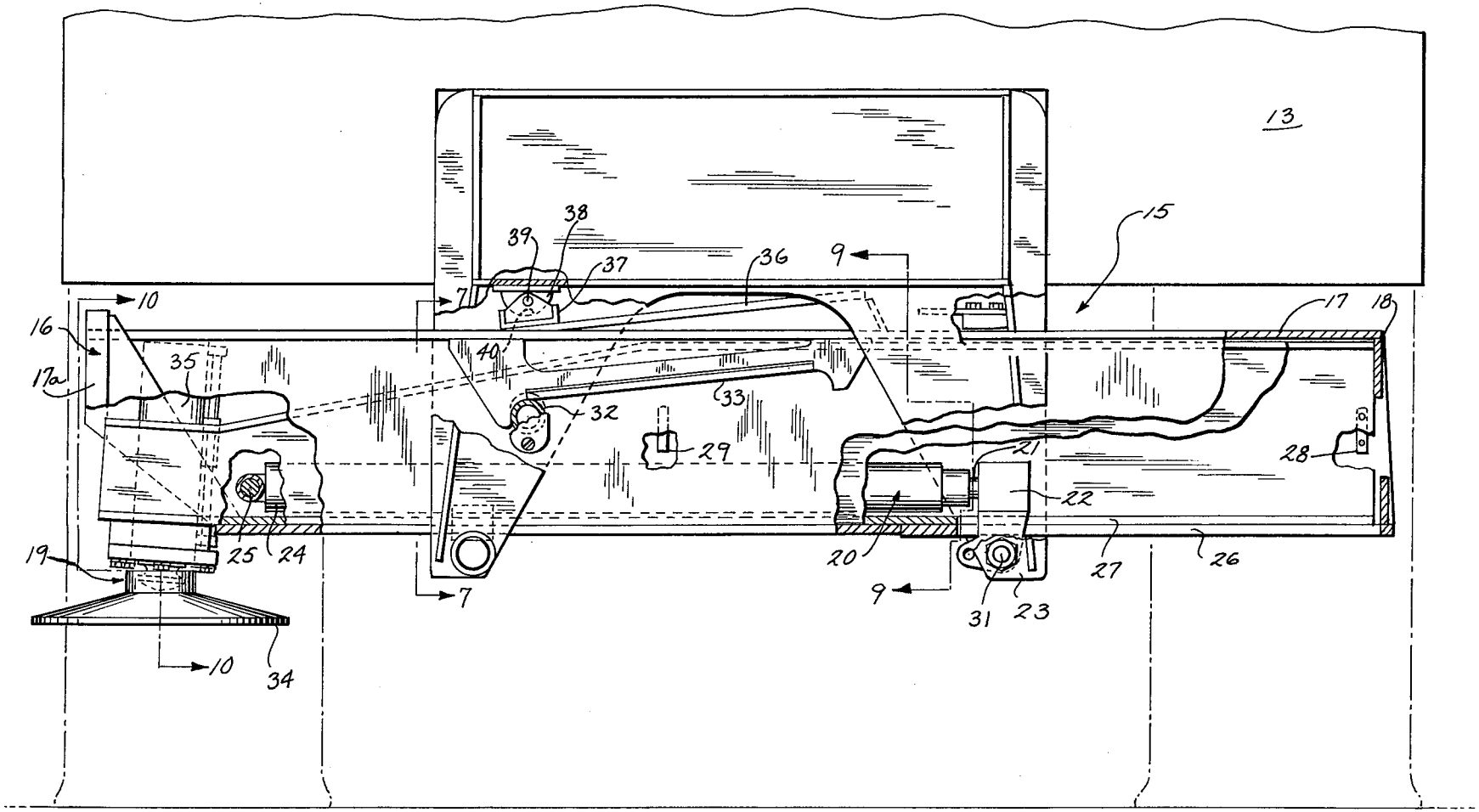
FIG. 5 is an enlarged rear elevational view partially in section of a single arm of the rear outrigger assembly with the arms in storage position and the cover plate removed.

In FIG. 5 a single outrigger arm 16 is illustrated in an enlarged view with the cover plate removed and partially in section so that the details can be seen. The arm 16 is shown in retracted position. As seen in FIG. 4 and previously described, the arm 16 comprises a housing 17, and a beam 18 which is equipped at one end with a floating jack 19. The beam 18 is positioned within the housing 17 and is, therefore, shown in broken lines. In addition, there is seen for the first time, partially in broken lines, a fluid-actuated, three-piece cylinder 20 which serves to extend the beam 18 and the housing 17. The cylinder 20 is positioned within the telescoped hollow beam 18 and hollow housing 17 and has a two-piece piston rod 24 which extends within the hollow interior of the beam 18 to a point 25 adjacent the outer end of said beam 18 and the float jack 19 where it is pinned or fastened. The base 21 of the cylinder 20 is hingedly anchored to a mounting bracket 22 which is in turn mounted on the support 23.

Figure 6:
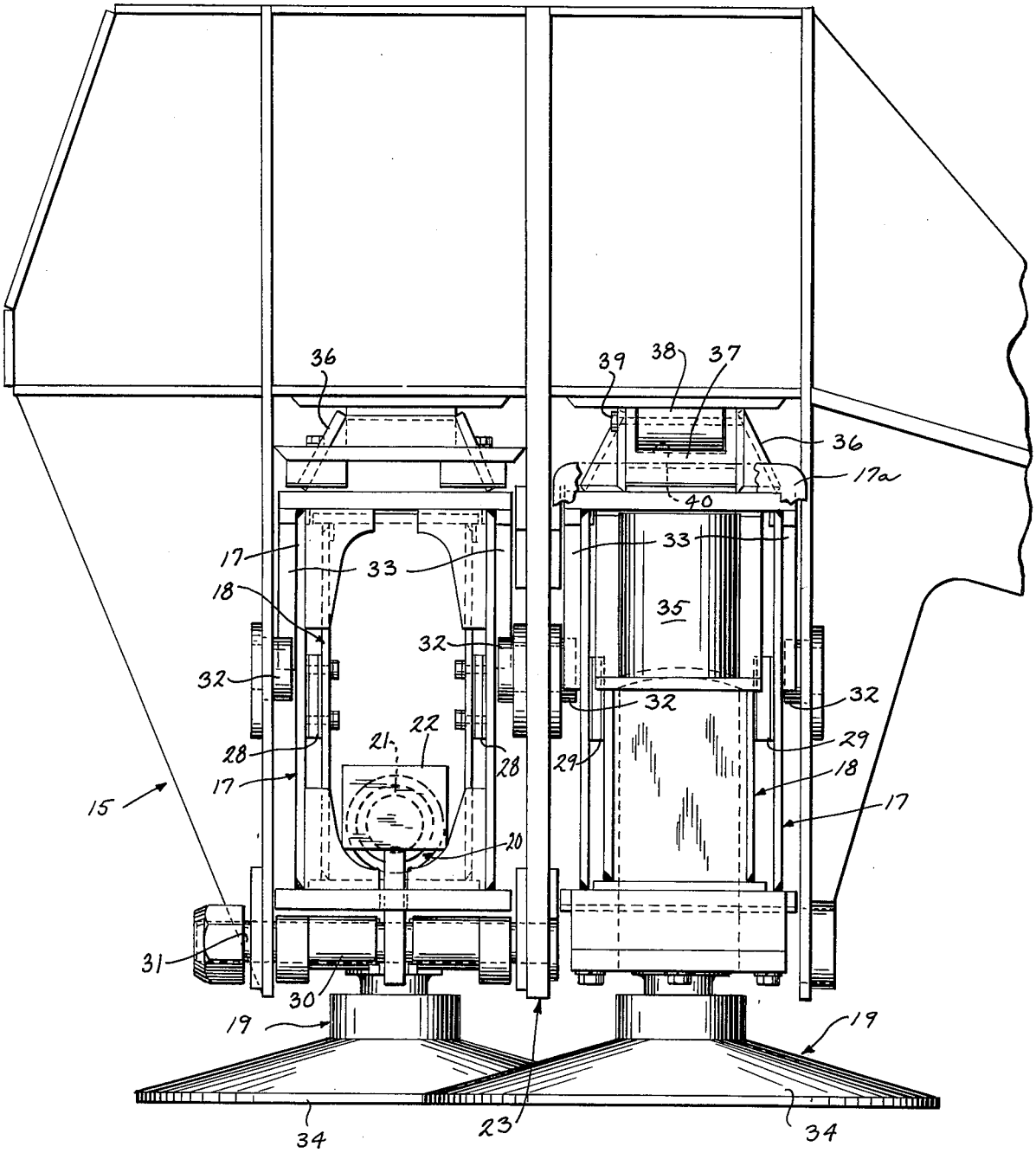
FIG. 6 is a plan view taken along lines 6—6 of FIG. 5.
Figure 9:
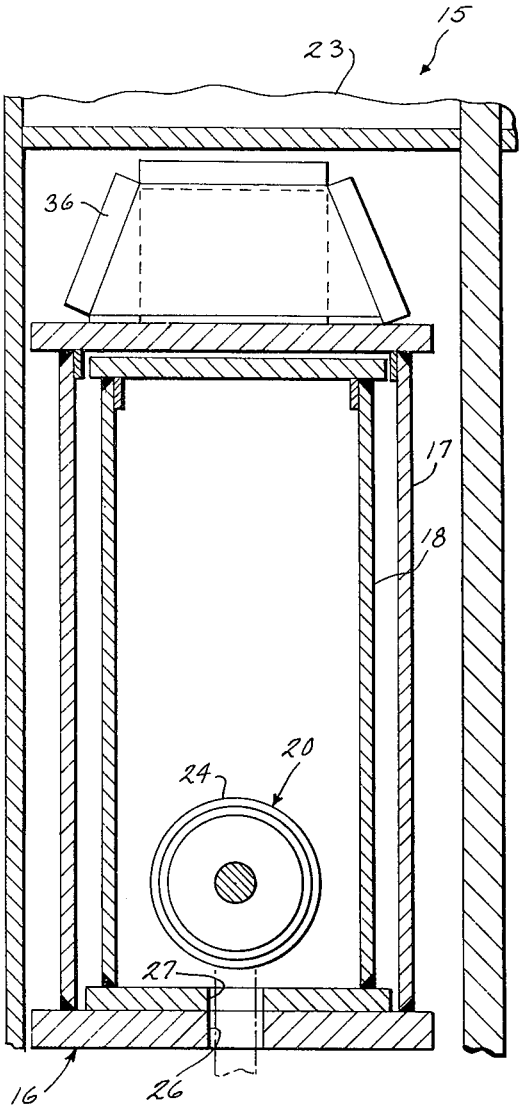
FIG. 9 is a plan view taken along lines 9—9 of FIG. 5.

In FIGS. 5, 6 and 9 it can be seen that to accommodate the mounting bracket 22, the bottoms of the housing 17 and the beam 18 are provided with a longitudinally extending slot 26 and 27 respectively. The width of slots 26 and 27 is sized so that the mounting bracket 22 for the hydraulic cylinder 20 can freely extend therethrough without interfering with the sideward or downward movement of the housing 17 or the beam 18. The length of slots 26 and 27 is determined primarily by the length of the housing it is desired to extend and the construction of the support member 23.

Turning once again to FIG. 5, it can be seen that the beam 18 is provided with a stop 28 on the outside of its innermost end and that the housing 17 also is provided with an internal stop 29. The stops 28 and 29 cooperate to limit the extension of the beam 18 and to extend the housing 17 once the beam has been fully extended.

Figure 7:
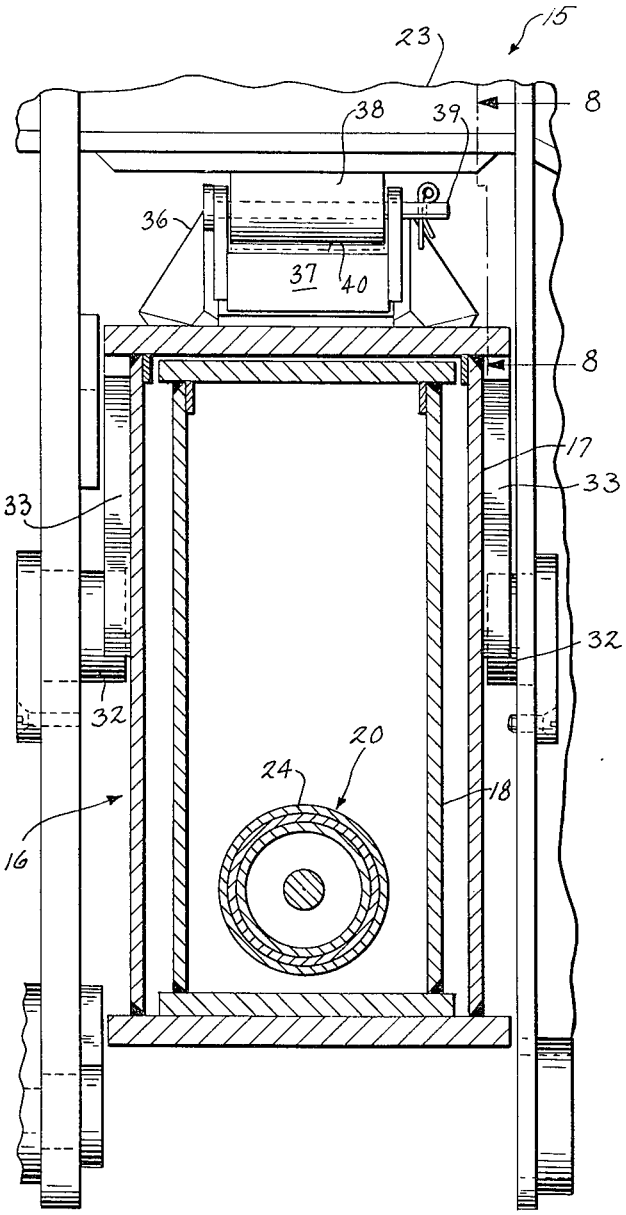
FIG. 7 is a plan view taken along lines 7—7 of FIG. 6.

The preferred mechanism for extending the beam 18 and the housing 17 sidewards is best seen in FIGS. 5, 6 and 7. In FIG. 5, can be seen the fluid-actuated cylinder 20 which is the extending force and in FIG. 6, can be seen slides 30 that support the rear portion of the housing, and the pin 31 which not only supports the slides 30 but also anchors the bracket 22 which is attached to the base 21 of the cylinder 20 and to the support 23.

Returning to FIG. 5, there can be seen the slides 32 which are mounted on internal sides of the support 23 and which cooperate with cam surfaces 33 on each side of the housing 17 to tilt or translate the housing downwardly. Although only one cam surface 33 can be seen in FIG. 5, both sides of the housing 17 are preferably provided with cam surfaces 33 as seen in FIG. 7. The slides 32 on the support which cooperate with the cam surface 33 can be seen in greater detail in FIG. 6.

As seen in FIGS. 3, 4, 5 and 6, the outermost portion of the beam is provided with ground support means such as a floating jack 19. In the preferred embodiment as best seen in FIG. 6, the float jack 19 is provided with a pivoted foot 34 and its own fluid-actuated cylinder 35 which is capable of vertical movement to extend and retract the foot 34. The cylinder 35 of the float jack 19 is sized to be received and stored in the free end of the housing 17 which is preferably biased at its outer end **17*a* as seen in FIG. 3** to accommodate the float jack and thus minimize overhang.

When the beam 18 has been fully extended, the housing 17 has been extended and translated downward and the float jack 19 extended to lift the vehicle, the load must be transferred to the vehicle frame. As seen in FIG. 4, to accomplish this the top of the housing 17 is provided with an integral ramp 36 and a pivoted main loading block 37 is mounted on the support 23.

Figure 8:
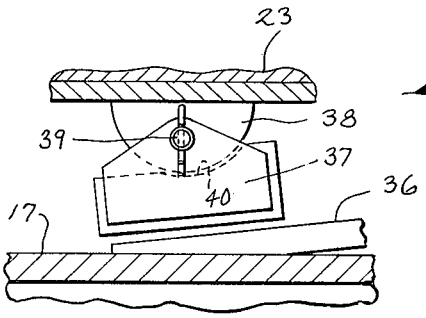
FIG. 8 is a plan view taken along lines 8—8 of FIG. 7.

In FIGS. 6, 7, 8 and 9, the ramp 36 and pivoted main loading block 37 can be seen in greater detail. In FIG. 7 it can be seen that an integral semicylindrical boss 38 is attached to the ceiling of the support 23, and that the main loading block 37 is attached to the boss 38 in a pivotable manner by a pin 39. The pivoted relationship of the block 37 and boss 38 is best seen in FIG. 8, in which it is seen that the block 37 is provided with a recess 40 to receive the boss 38 and to permit the block 37 to pivot and thus maintain a constant clearance between the ramp 36 and the block 37. Turning to FIG. 9, it can be seen that in the preferred embodiment the ramp 36 is truncated and an integral part of the housing 17.

When it is desired to employ the outrigger system to stabilize the vehicle, the cylinder 20 is actuated to cause the two-piece piston rod 24 to extend and move the beam 18 out of the housing 17. The beam 18 extends until the stop 28 on the outside of the beam contacts the stops 29 on the inside of the housing 17; then as the two-piece piston rod 24 of the cylinder 20 continues to extend, the housing 17 is also moved sidewards along with the beam 18. As the housing 17 moves sidewards, the bottom of the housing moves over the slides 30 and at the same time the cam surfaces 33 on the sides of the housing 17 cooperate with the slides 32 to translate or tilt the housing 17 downwardly. When the housing 17 is fully extended, as seen in FIG. 4, or at least extended as far as desired, the extension of the outrigger arm 16 can be locked by conventional locking means, if desired, and the fluid-actuated cylinder 35 of the float jack 19 can be activated to extend the foot 34 downwardly to contact the ground or supporting surface and to lift the vehicle off the ground. By the technique of blocking-up under the outrigger feet, the vehicle can be raised with the housing 17 in any position of extension.

As previously described, the ramp 36 on top of the housing and pivotable loading block 37 on the support 23 are provided to transfer the loading of the outrigger back to the frame of the vehicle. The transfer of the load can be traced as follows, first the load is transferred from the ground to the float jack foot 34, then to the vertical cylinder 35, then to the beam 18, then to the housing 17, then to the pivotable loading block 37, which transfers the load through the ramp 36 to the support 23. The load from the rear of the housing 17 is transferred to the slide supports 30, to the pin 31 and then to the support 23. The support 23 is bolted or otherwise attached to the frame of the vehicle to which the load is finally transferred.

In operation, the main load upon the outrigger system is carried by the pivotable loading block 37 and ramp 36. It is important, therefore, that in order to allow the housing 17 to slide when being extended or retracted, that a constant clearance is provided between the loading block 36 and the housing 37. This clearance exists when there is no load on the outrigger arms 16 and is maintained constant by the pivotable nature of the loading block 36 which has previously been described.

When it is desired to return the outrigger system to the storage position shown in FIG. 3, the vertical cylinders 35 attached to the float jack 19 are retracted to lower the vehicle down onto its wheels; the vertical cylinders 35 are then fully retracted to the position seen in FIG. 4, and the cylinder 20 which controls the extension of the beam 18 and the housing 17 is reactivated to retract the two-piece piston rod 24 attached to the beam 18 and housing 17. As the piston rod 24 retracts, the beam 18 is retracted first and telescoped into the housing until the vertical cylinder 35 and the float jack 19 are in the storage position in the biased end of the housing 17. As the piston rod 24 continues to be retracted, the sidewards and downward extension of the housing 18 is reversed.

Although the foregoing description has been directed to the rearmost outrigger arm, it is to be understood that each of the four outrigger arms is of similar construction and is mounted in similar manner to the vehicle frame. Moreover, the interrelationship of the forward pair of arms is the same as that described herein with respect to the rear pair of the arms. From the foregoing description it also will be apparent that the described outrigger system, which has its own support is self-contained and can be removed or attached to the vehicle by conventional means.

The preferred embodiments of the invention shown and described are highly effective, but it will be obvious that various modifications might be made without departure from the spirit of the invention. The invention may, for example, be employed with beams and housings of different shapes and other means of translating or tilting the housings such as separate cylinders may be employed. In addition, other equivalents may be substituted for the specific structures described.

In view of the possible modifications, the invention is not intended to be limited by the showing or description herein, or in any other manner, except insofar as may specifically be required.

We claim:

1. An outrigger system for increased stability which comprises:

a support member, an extendible housing movably supported on said support member, a beam telescopically positioned within said housing and adapted for sidewards movement out of said housing, stop means on said beam and on the housing to prevent said beam from being moved completely out of said housing, a float jack on the free end of said beam, and a fluid-actuated cylinder having an extensible piston rod, and a base, the base of said cylinder being anchored to the support member which extends through a slot in housing and the free end of the piston rod being attached to the beam so that as the piston rod is extended the beam is moved sidewardly out of said housing, until said beam is substantially fully extended at which time the stop means on the housing and beam coact to prevent further sidewards extension of the beam at which time further extension of the piston rod moves the housing sidewardly thus providing greater reach and stability than with the beam alone.

2. An outrigger system of claim 1 in which the housing and the support member are provided with translating means which translate the housing downwardly as it extends sidewards.

3. An outrigger system of claim 1 in which the translating means comprise cam surfaces on the sides of the housing which coact with the guide members on the support member to translate the housing downwardly as it extends sidewards.

4. An outrigger system of claim 1 in which the top of the housing is provided with an integral ramp and the support member is provided with a pivotable loading block whereby the ramp and loading block can coact to distribute load exerted on the housing to the support member.

5. An outrigger system for equipment requiring increased stability which comprises:

a. a support member adapted to be attached to said equipment, b. at least one extendible outrigger arm supported by said support member, said outrigger arm comprising a housing member, and at least one extendible beam telescopically positioned within said housing member, said housing member being supported upon said support member in such a manner that the housing member may be extended sidewardly to provide a greater extension and reach and a resulting increased stability, said housing member and support member being provided with translating means comprising a cam surface on the side of one of said members and a guide member on the side of the other of said members which coact to translate the housing downwardly as it extends sidewards, and c. means for extending said outrigger arm.

6. The outrigger system of claim 5 in which the top of the housing member is provided with an integral ramp and the support member is provided with a pivotable loading block whereby the ramp and loading block can coact to distribute load exerted on the housing member to the support member.

7. The outrigger system of claim 5 in which the means for extending the arm is a fluid-actuated cylinder.

8. The outrigger system of claim 5 in which there ae two outrigger arms which extend sidewards in opposite directions.

* * * * *